US008474931B2

(12) United States Patent
Kondo

(10) Patent No.: US 8,474,931 B2
(45) Date of Patent: Jul. 2, 2013

(54) PRINTING APPARATUS AND PIGMENT INK STIRRING METHOD

(75) Inventor: Mitsuru Kondo, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/230,986

(22) Filed: Sep. 13, 2011

(65) Prior Publication Data

US 2012/0081421 A1 Apr. 5, 2012

(30) Foreign Application Priority Data

Oct. 5, 2010 (JP) ..... 2010-226057

(51) Int. Cl.
*B41J 2/195* (2006.01)
*B41J 2/175* (2006.01)

(52) U.S. Cl.
USPC ..... 347/7; 347/86

(58) Field of Classification Search
None
See application file for complete search history.

(56) References Cited

U.S. PATENT DOCUMENTS

2011/0025790 A1* 2/2011 Serizawa et al. ..... 347/86

FOREIGN PATENT DOCUMENTS

| | | | |
|---|---|---|---|
| JP | 8-258281 | A | 10/1996 |
| JP | 2007-301772 | A | 11/2007 |
| JP | 2011-031468 | A | 2/2011 |

* cited by examiner

*Primary Examiner* — Geoffrey Mruk
(74) *Attorney, Agent, or Firm* — Fitzpatrick, Cella, Harper & Scinto

(57) ABSTRACT

This invention is directed to a system for stirring pigment ink whose pigment particles in a container subside without moving the container containing pigment ink, and detecting that pigment particles have been stirred satisfactorily. To achieve this, a pair of electrodes greatly different in surface area and at least one of which has an inconstant width are arranged outside a container containing pigment ink whose pigment particles subside. An AC power supply is connected to the electrodes and applies an AC voltage to them. Then, an electric field generated between the electrodes causes induced polarization in pigment particles which subside in the container. The pigment particles are attracted to a portion having high electric field intensity. Convection occurs in the container, stirring the subsiding pigment particles. Based on a voltage detected by an interelectrode voltage detector, it is detected that pigment particles are dispersed sufficiently.

9 Claims, 8 Drawing Sheets

PRINTING APPARATUS AND PIGMENT INK STIRRING METHOD

BACKGROUND OF THE INVENTION

1. Field of the Invention

The present invention relates to a printing apparatus having a system for stirring pigment ink, and a pigment ink stirring method.

2. Description of the Related Art

When an inkjet printing apparatus using pigment ink as a printing material has not printed for a long time and the pigment ink is left to stand for a long time, the pigment concentration (space distribution) of the pigment ink becomes nonuniform in the ink tank due to gravitational sedimentation of pigment particles heavier in specific gravity than the solvent of the pigment ink. A printing operation after long-term inexecution of printing cannot print with optimum image quality. To prevent this, an inkjet printing apparatus (to be referred to as a printing apparatus) in which an ink tank is mounted on a carriage horizontally moves the carriage to violently shake the ink tank, stirring the pigment ink in the ink tank. This homogenizes the pigment particle concentration (space distribution) in the ink tank.

For example, Japanese Patent Laid-Open No. 2007-301772 discloses a method of setting a carriage reciprocal movement condition to stir ink in an ink tank in accordance with the printing amount in a printing operation if the elapsed time after the end of reciprocal movement of the carriage on which a printhead and ink tank are mounted is shorter than a predetermined time. By reciprocating the carriage in accordance with the reciprocal movement condition, ink can be efficiently stirred depending on the ink status in the ink tank. As a result, ink such as pigment ink in the ink tank can be homogenized, printing a high-quality image.

Japanese Patent Laid-Open No. 8-258281 discloses an inkjet head including an ink tank which contains ink, an ink filter connected to it, a common ink chamber connected to the filter, and a plurality of nozzles connected to the common ink chamber. The head further includes ink orifices corresponding to the respective nozzles, at least a pair of electrodes which are arranged in the ink tank and have different surface areas, and an AC voltage application unit which applies a voltage to these electrodes different in surface area. With this arrangement, when an AC voltage is applied to the pair of electrodes different in surface area, the electrode smaller in surface area can absorb dust and dirt in ink. This can implement an ink discharge device which removes, from ink, dust and dirt large enough to cause clogging and prevents clogging of the ink filter even when the mesh of the ink filter is set to a size small enough to remove small dust and dirt.

In an inkjet printing apparatus using pigment ink, to efficiently stir and homogenize pigment ink whose pigment particles gravitationally sediment, an arrangement which reciprocates the ink tank-mounted carriage is effective, as disclosed in Japanese Patent Laid-Open No. 2007-301772.

However, when the printhead and ink tank are separated and only the printhead is mounted on the carriage to increase the ink tank capacity and lighten the carriage, the arrangement disclosed in Japanese Patent Laid-Open No. 2007-301772 cannot stir pigment ink. This is because the ink tank is fixed to the printing apparatus main body and even moving the carriage cannot stir pigment ink in the ink tank. Hence, another stirring method is necessary for the arrangement in which the ink tank is fixed to the printing apparatus.

Further, the arrangement disclosed in Japanese Patent Laid-Open No. 2007-301772 does not include a means for detecting whether or not pigment ink has been stirred. The stirring count is set based on the elapsed time after a previous carriage reciprocal operation and the print data amount. However, in this arrangement, if the ink tank is replaced after a previous carriage reciprocal operation, the stirring operation may become insufficient or take time more than necessary.

In the arrangement disclosed in Japanese Patent Laid-Open No. 8-258281, the electrode smaller in surface area can absorb pigment particles, similar to dust and dirt. However, pigment ink in the ink tank cannot be homogenized. Thus, a means for causing convection in pigment particles to positively stir the pigment ink is required.

SUMMARY OF THE INVENTION

Accordingly, the present invention is conceived as a response to the above-described disadvantages of the conventional art.

For example, a printing apparatus and pigment ink stirring method according to this invention are capable of stirring pigment ink and reliably detecting the dispersion state of pigment particles without mechanically shaking the ink tank or electrically affecting the pigment ink.

According to one aspect of the present invention, there is provided a printing apparatus which prints on a printing medium by supplying ink from a first container that is formed from an electrically insulating member and contains pigment ink containing a solvent and pigment particle different in permittivity, to a printhead that is separated from the first container and mounted on a carriage that reciprocally moves, comprising: a thin plate-like first electrode which is arranged to contact an outer surface of the first container; a thin plate-like second electrode which is smaller in surface area than the first electrode, and is arranged to face the first electrode and contact an outer surface of the first container such that the first and second electrodes sandwich the first container; an AC power supply unit configured to apply an AC voltage to the first electrode and the second electrode; a detection unit configured to detect an interelectrode voltage between the first electrode and the second electrode; and a control unit configured to control to stop application of the AC voltage from the AC power supply unit based on one of the interelectrode voltage detected by the detection unit and a change rate of the interelectrode voltage.

According to another aspect of the present invention, there is provided a pigment ink stirring method for a printing apparatus which prints on a printing medium by supplying ink from a first container that is formed from an electrically insulating member and contains pigment ink containing a solvent and pigment particle different in permittivity, to a printhead that is separated from the first container and mounted on a carriage that reciprocally moves, comprising: applying an AC voltage from an AC power supply unit to a thin plate-like first electrode which is arranged to contact an outer surface of the first container and a thin plate-like second electrode which is smaller in surface area than the first electrode, and is arranged to face the first electrode and contact an outer surface of the first container such that the first and second electrodes sandwich the first container; detecting an interelectrode voltage between the first electrode and the second electrode; and controlling to stop application of the AC voltage from the AC power supply unit based on one of the detected interelectrode voltage and a change rate of the interelectrode voltage.

The invention is particularly advantageous since pigment ink can be stirred by a simple arrangement without mechanically shaking or electrically affecting the ink tank which contains the pigment ink. Further, an interelectrode voltage is detected, and whether or not pigment particles are satisfactorily dispersed can be determined by a simple arrangement using the voltage value or the change rate.

This can prevent degradation of the quality of a printed image caused by a nonuniform pigment particle concentration (space distribution) of pigment ink when pigment particles subside.

Further features of the present invention will become apparent from the following description of exemplary embodiments (with reference to the attached drawings).

DESCRIPTION OF THE EMBODIMENTS

An exemplary embodiment of the present invention will now be described in detail in accordance with the accompanying drawings.

In this specification, the terms "print" and "printing" not only include the formation of significant information such as characters and graphics, but also broadly includes the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be extensively interpreted similar to the definition of "print" described above. That is, "ink" includes a liquid which, when applied onto a print medium, can form images, figures, patterns, and the like, can process the print medium, and can process ink. The process of ink includes, for example, solidifying or insolubilizing a coloring agent contained in ink applied to the print medium.

Figure 1:
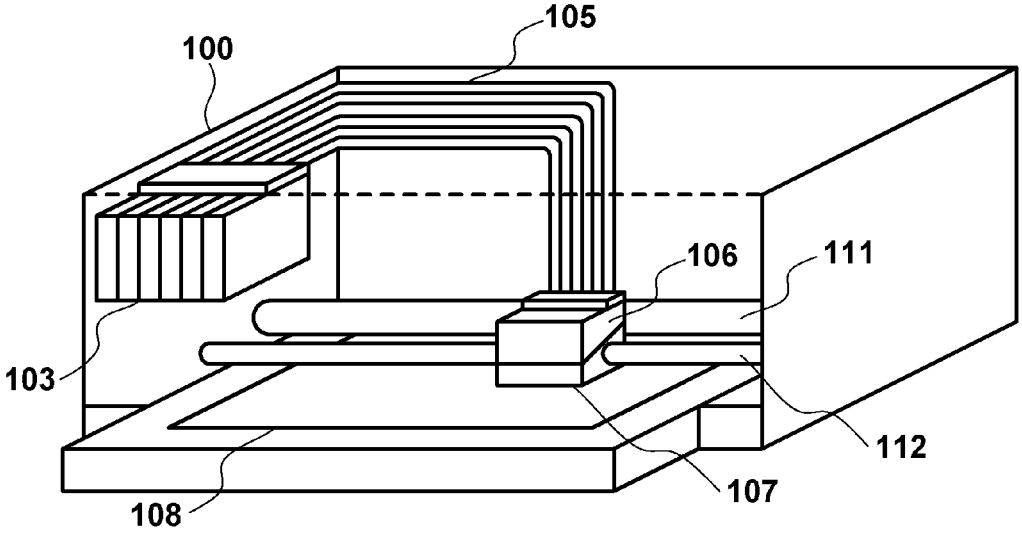
FIG. 1 is a perspective view showing the schematic arrangement of an inkjet printing apparatus as a typical embodiment of the present invention.

FIG. 1 is a perspective view showing the schematic arrangement of an inkjet printing apparatus (to be referred to as a printing apparatus) as a typical embodiment of the present invention. In the printing apparatus, an inkjet printhead (to be referred to as a printhead) and a large-capacity ink tank (first container) 103 are separated from each other. Only the printhead and a small-capacity ink tank (second container) 106 are mounted on a carriage, and the large-capacity ink tank is arranged in the printing apparatus main body. Ink contained in the large-capacity ink tank is supplied by a pump to the printhead via a tube which connects the printhead and ink tank.

Examples of this printing apparatus are a printer using printing paper of large sizes such as A0 and B0 as a printing medium, a printer mounted in a large-scale copying machine, a printer used in a manufacturing apparatus for an electronic device or the like, and an industrial printing apparatus such as a textile printing apparatus. Examples of the printing medium are paper and a plastic sheet for a printer, a glass substrate for a manufacturing apparatus, and cloth for a textile printing apparatus. This printing apparatus uses pigment ink as a printing material, and includes a pigment ink stirring system to stir the pigment ink in the ink tank.

As an inkjet method of discharging ink from the printhead, various methods are available, including a method using an electrothermal transducer (heater) for a printing element, a method using a piezoelectric element, a method using an electrostatic element, and a method using a MEMS element.

As shown in FIG. 1, the large-capacity ink tank (to be referred to as a main tank) 103 cannot be mounted on the carriage on which a printhead 107 is mounted, and is fixed to part of a housing 100 of the printing apparatus. The small-capacity ink tank (to be referred to as a sub-tank) 106 is arranged for the printhead 107 mounted on the carriage. A tube (channel) 105 connects the main tank 103 and sub-tank 106. A mechanism for pressurizing the main tank 103 from the outside or a pump mechanism inserted midway along the channel 105 is arranged to supply ink to the printhead 107.

In the embodiment, a head cartridge which integrates the sub-tank 106 and printhead 107 is mounted on the carriage. The carriage is guided and supported by two guide rails 111 and 112, and reciprocally moves along these guide rails with respect to a printing medium 108. At this time, the printhead 107 discharges ink to the printing medium 108 to print.

Figure 2:
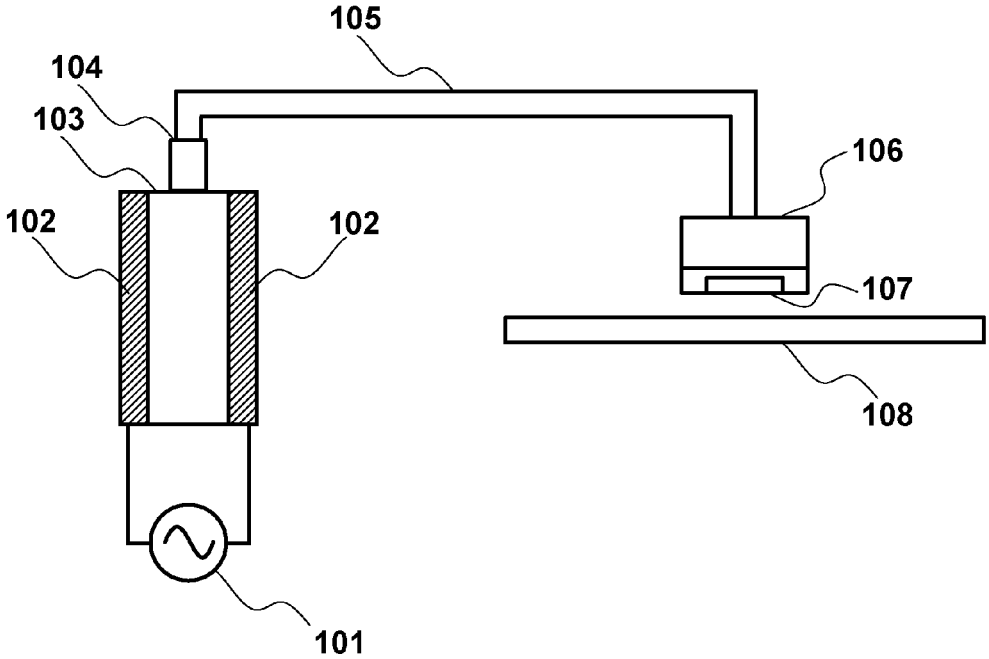
FIG. 2 is a block diagram showing the arrangement of a pigment ink stirring system in the printing apparatus shown in FIG. 1.

FIG. 2 is a block diagram showing the arrangement of a pigment ink stirring system in the printing apparatus shown in FIG. 1.

An electrically insulating member such as rubber, vinyl, or plastic is molded into a bag or hard case as the main tank 103. The main tank 103 is connected to the tube 105 at a connection portion 104. At least a pair of electrodes 102 which are greatly different in surface area and made of a conductor such as copper are arranged to contact the outside of the main tank 103. An AC power supply 101 applies an AC voltage to the electrodes 102. Of the pair of electrodes 102, an electrode larger in surface area will be called the first electrode, and an electrode smaller in surface area will be called the second electrode.

Note that no electric discharge occurs even when the pair of electrodes 102 come closest while sandwiching the main tank 103, as shown in FIG. 2. The main tank 103 is thin (up to about 2.0 mm) so that the electrode 102 outside the main tank 103 and pigment ink in the main tank 103 come as close as possible to each other, and is strong enough not to leak pigment ink in the main tank 103. The distance between the pair of electrodes 102 via the main tank 103 is set to about 1 cm so that they are not spaced apart from each other excessively. Note that the electrode 102 has a thin plate shape about 0.05 mm thick.

Figure 3:
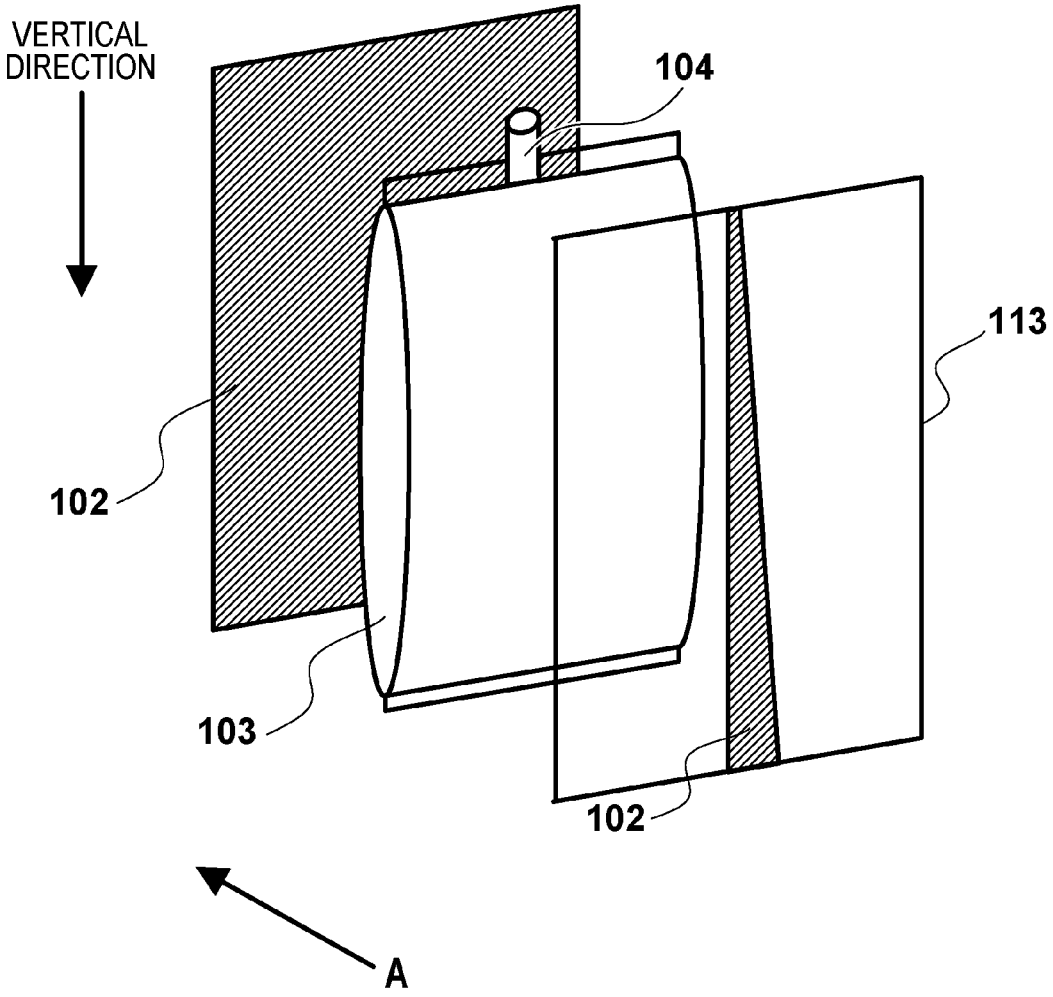
FIG. 3 is a perspective view exemplifying the installation of a main tank and electrodes.

FIG. 3 is a perspective view exemplifying the installation of the main tank 103 and electrodes 102.

As shown in FIG. 3, the pair of electrodes 102 which are greatly different in surface area and at least one of which has an inconstant width are arranged to face each other via the main tank 103 containing pigment ink, and contact the outer surface of the main tank 103. When the main tank 103 has a bag shape as shown in FIG. 3, the electrodes 102 are installed to contact the main tank 103. Hence, the electrodes 102 are directly fixed to the main tank 103. Alternatively, the electrode 102 is fixed to an electrode fixing plate 113 such as a plastic or mold plate so that only the main tank 103 can be exchanged, and then installed to contact the main tank 103.

The pair of electrodes 102 are installed to contact outer surfaces which have the largest area out of outer surfaces of the main tank 103 and minimize the interval between the facing electrodes, in order to efficiently stir pigment ink. The pair of electrodes 102 are greatly different in surface area. An electrode larger in surface area, that is, the first electrode has a rectangular shape equal in area to the largest-area surface of the main tank 103. An electrode smaller in surface area, that is, the second electrode has an area ratio of about 1:10 to the first electrode. The second electrode has a shape which generates portions with high and low electric field intensities in an electric field generated between the electrodes when an AC voltage is applied. Further, this shape has a wide portion and narrow portion in the vertical direction (elongated trapezoidal shape).

Figure 4:
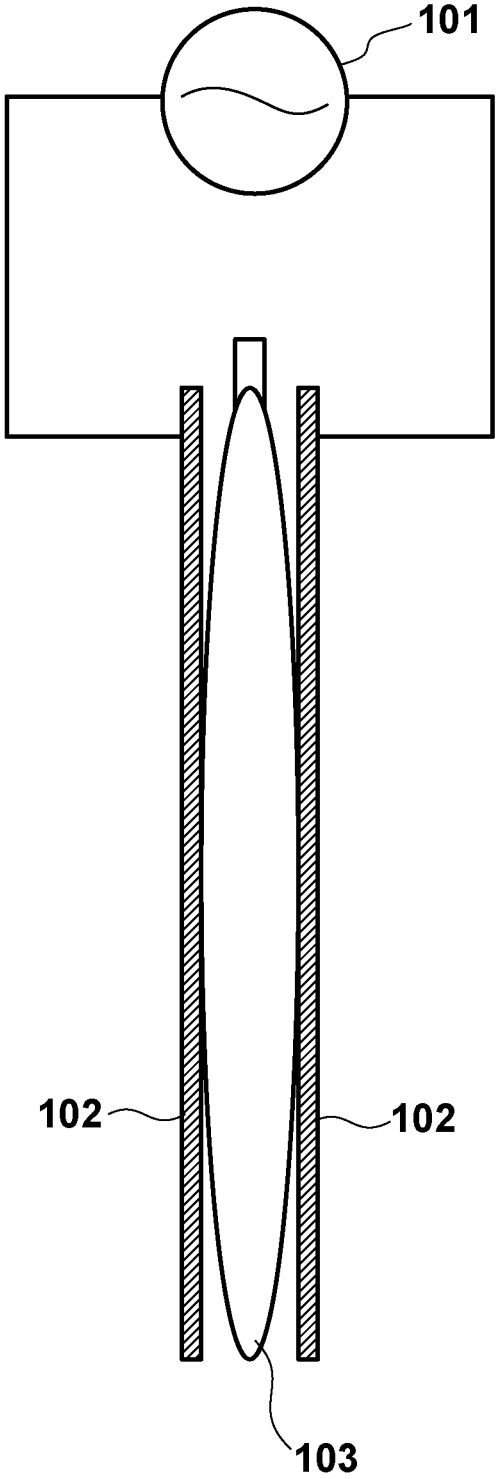
FIG. 4 is a view showing the connection between an AC power supply and the electrodes.

FIG. 4 is a view showing the connection between the AC power supply 101 and the electrodes 102. The AC power supply 101 and electrodes 102 are directly connected. The pair of electrodes 102 different in surface area sandwich the main tank 103. The application voltage value of the AC voltage is set to about 1 kV to several kV, and the frequency is set to about 60 kHz.

Figure 5:
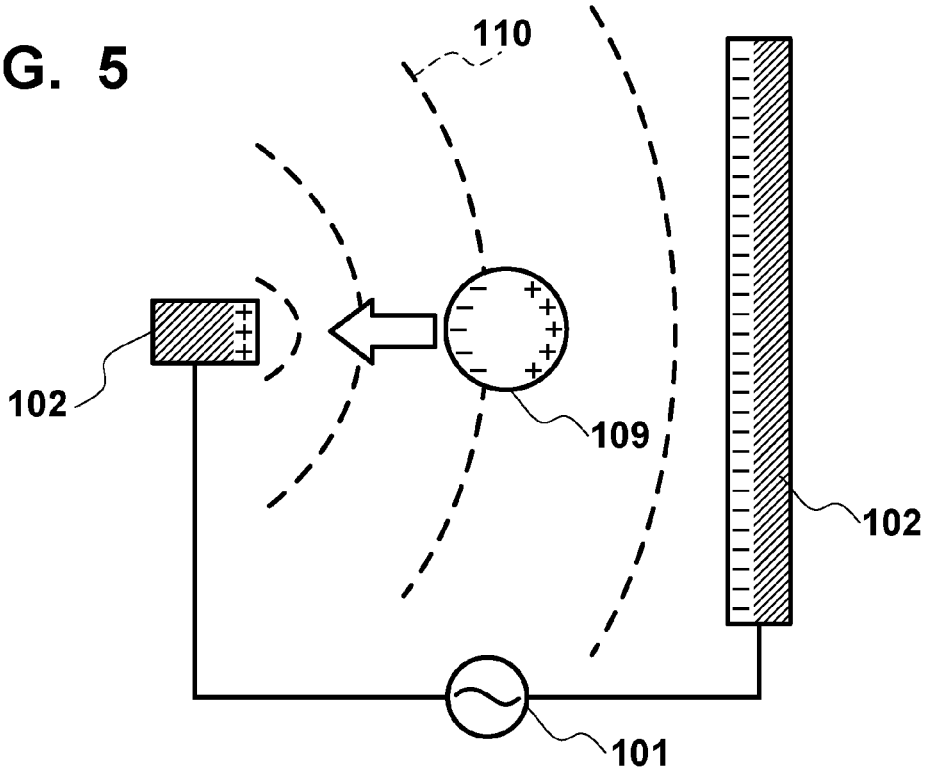
FIG. 5 is a view showing a pigment ink stirring principle.
Figure 6:
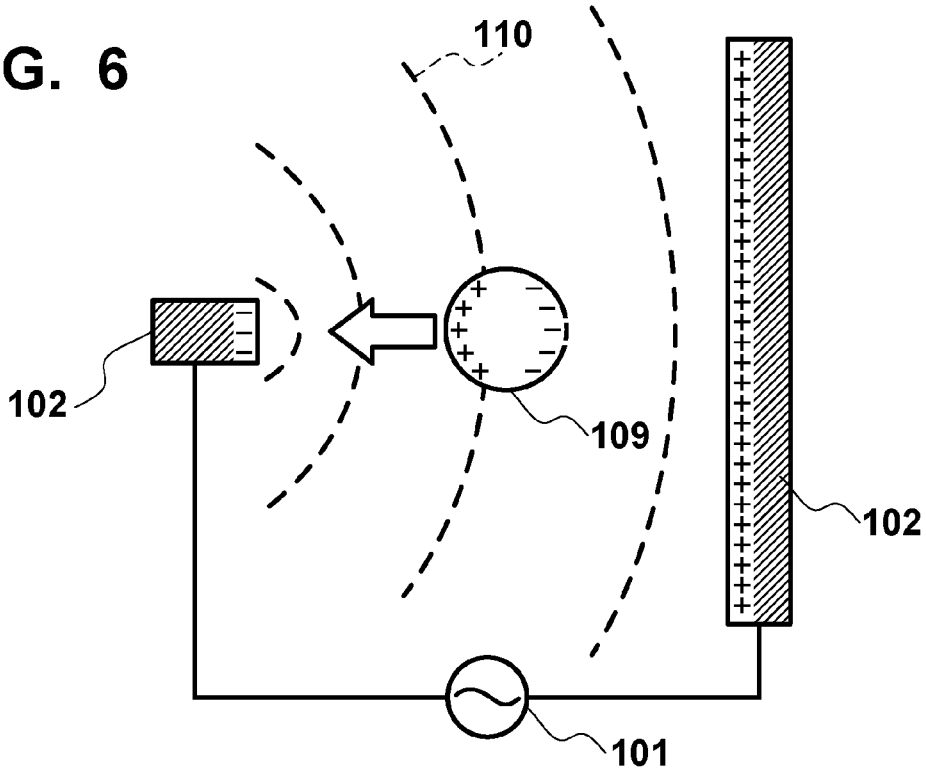
FIG. 6 is a view showing the pigment ink stirring principle.

FIGS. 5 and 6 are views showing a pigment ink stirring principle. When an AC voltage is applied to the electrodes 102, an electric field 110 is generated between them. In the use of a pair of electrodes greatly different in surface area, the electric field intensity increases toward the second electrode smaller in surface area. At this time, such an electric field 110 causes induced polarization in a pigment particle 109. Negative charges move toward a portion having high electric potential, and positive charges move toward a portion having low electric potential. However, the absolute values of positive and negative charges are equal. Note that the pigment particle 109 is illustrated at a relatively large size to depict the charging state of the pigment particle 109. Letting E be the electric field intensity, an electrostatic attractive force F given by =QE generated.

In the state shown in FIG. 5, the second electrode smaller in surface area having a positive electric potential is higher in electric field intensity than the first electrode larger in surface area having a negative electric potential. In other words, electric field intensity of the second electrode is higher than that of the first electrode. Thus, the induced polarized pigment particle 109 moves to the second electrode. Even if the sign is inverted and the electric potential is reversed, as shown in FIG. 6, the polarization direction of the pigment particle 109 is also reversed. The direction in which the pigment particle 109 moves does not change, and the pigment particle 109 moves to the second electrode having higher electric field intensity.

Figure 7:
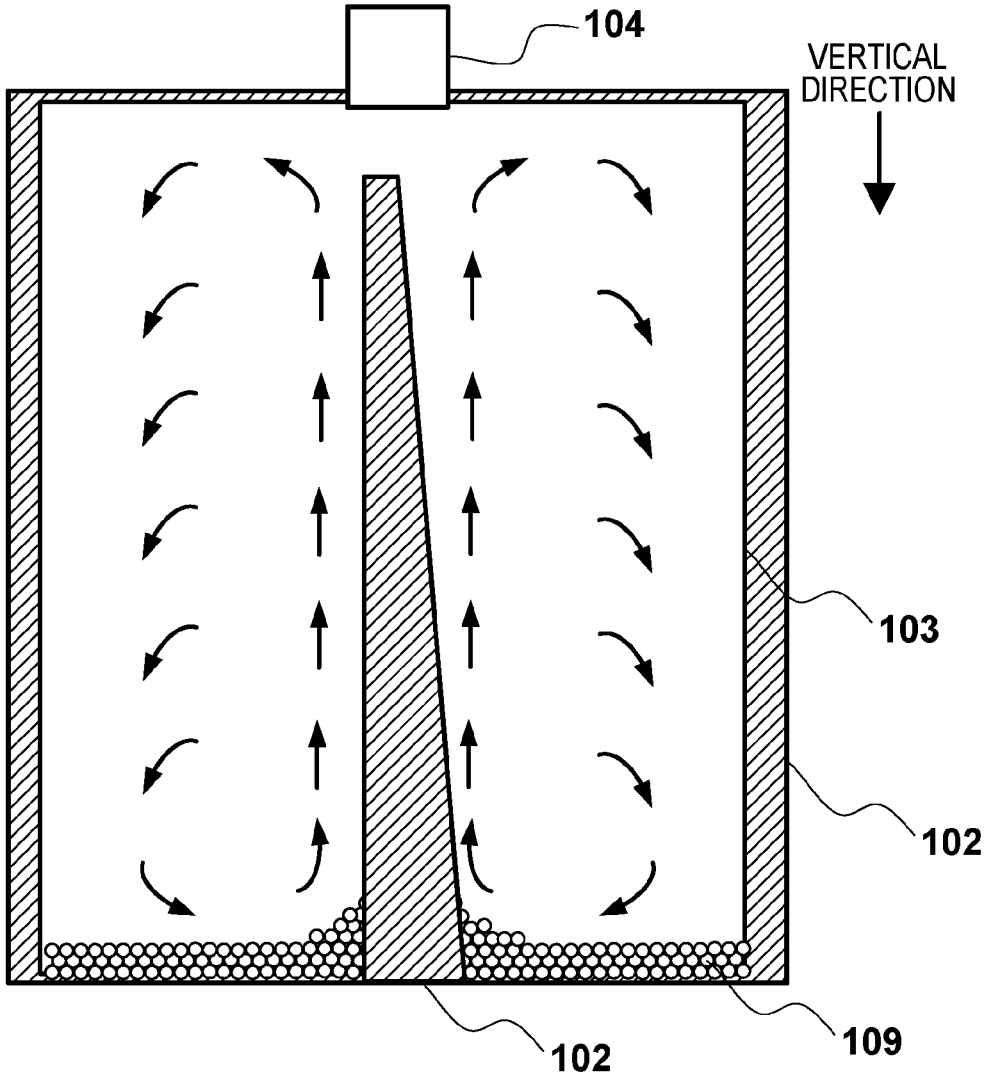
FIG. 7 is a view showing a pigment ink stirring operation.

FIG. 7 is a view showing a pigment ink stirring operation. FIG. 7 shows a state when the state in FIG. 3 is viewed in a direction indicated by an arrow A. FIG. 7 is a front view showing the largest-area surface of the main tank 103 containing pigment ink. In FIG. 7, the second electrode smaller in surface area is on the near side, and the first electrode larger in surface area is on the far side via the main tank 103 containing pigment ink. The second electrode has a shape which is wide at the bottom and slightly narrows upward.

In FIG. 7, the pigment particles 109 subside at the bottom of the main tank 103. The actual pigment particle 109 has a diameter of about 0.1 μm and is very small. An AC voltage is applied to the pair of electrodes 102 greatly different in surface area, generating an electric field between them.

In the electrode arrangement as shown in FIG. 7, the electric field intensity becomes high at the narrow portion of the second electrode smaller in surface area. The pigment particles 109 which subside at the bottom of the main tank 103 start ascending along the electrode toward the narrow portion of the electrode smaller in surface area. During the ascending process, part of pigment particles 109 spaced apart from the electrode gravitationally sediment. However, most of pigment particles 109 reach the boundary surface between the pigment ink and air by the momentum of ascending, widely spread, and gravitationally sediment again. In this way, convection is generated as indicated by arrows in FIG. 7. As a result, the subsiding pigment particles 109 can be stirred within a short time.

Figure 8:
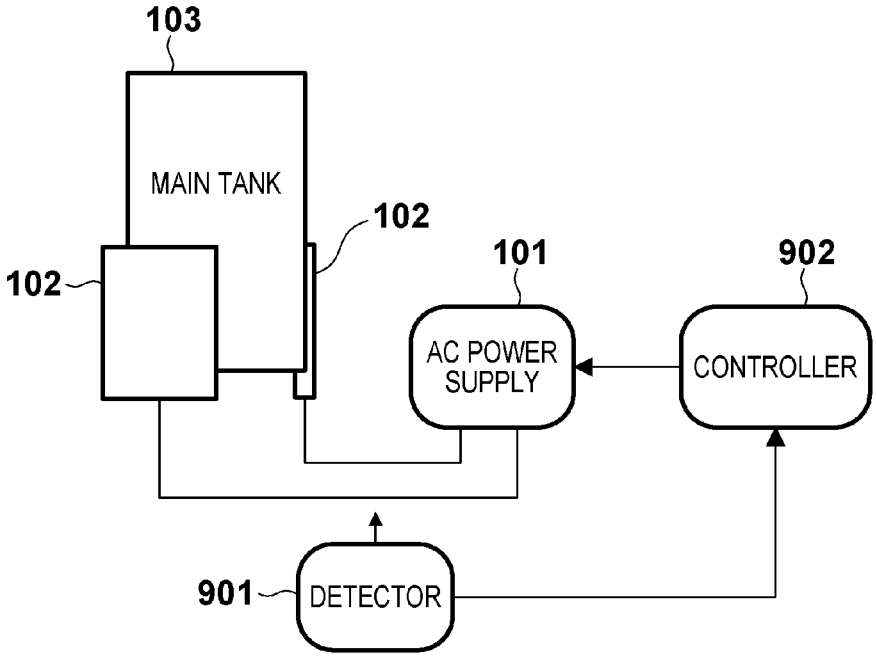
FIG. 8 is a block diagram showing the functional arrangement of the pigment ink stirring system.

FIG. 8 is a block diagram showing the functional arrangement of the pigment ink stirring system.

Upon receiving a command from a controller 902, the AC power supply 101 generates an AC voltage to the electrodes 102. A detector 901 is connected to at least one of the pair of electrodes 102, and detects an interelectrode voltage. The controller 902 receives the interelectrode voltage value from the detector 901, and determines based on the value whether or not to turn off the AC power supply 101.

Figure 9:
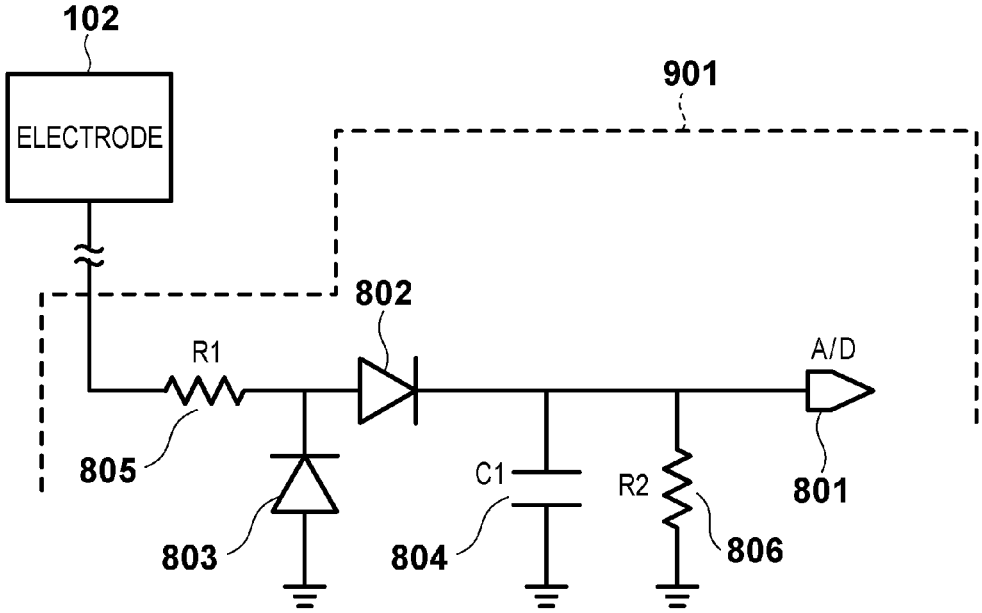
FIG. 9 is an equivalent circuit diagram showing an electrical circuit applied to a detector.

FIG. 9 is an equivalent circuit diagram showing an electrical circuit applied to the detector 901. In the arrangement shown in FIG. 9, an AC current supplied to the electrode 102 is smoothed by two diodes 802 and 803 and a capacitor C1 804 via a resistor R1 805. The smoothed current flows into a resistor R2 806, generating an electric potential difference between both sides of the resistor R2 806.

It is necessary to set a very large value at the resistor R1 805 and set the detector 901 in a high impedance state when viewed from the electrodes 102, so that a voltage generated in the electrodes 102 is neither smoothed nor affected by this circuit. The value of a voltage generated in the resistor R2 806 is obtained by dividing a voltage generated in the electrodes 102 by the resistor R1 805 and resistor R2 806.

Considering the above, for example, when a voltage generated by the AC power supply 101 is 5 kV, an electric potential difference of about 0 to 5 V is generated between both sides of the resistor R2 806 by setting R1=10 MΩ and R2=10 kΩ. An A/D converter 801 A/D-converts the electric potential difference, and transfers it as a digital value to the controller 902.

A phenomenon in which a different voltage is generated between both sides of the resistor 806 depending on the subsidence state of pigment ink which exists between the electrodes 102 will be explained. When liquid such as ink exists as insulator between the pair of electrodes 102, it acts as a dielectric material and can be apparently handled as a capacitor. The solvent of the pigment ink and the pigment particle are different in permittivity. The permittivity therefore differs between a state in which the pigment particles of the pigment ink subside and are locally concentrated, and a state in which they are uniformly dispersed in the ink. In this manner, charges staying between the electrodes 102 and thus a generated voltage change depending on the subsidence state of pigment particles.

Figure 10:
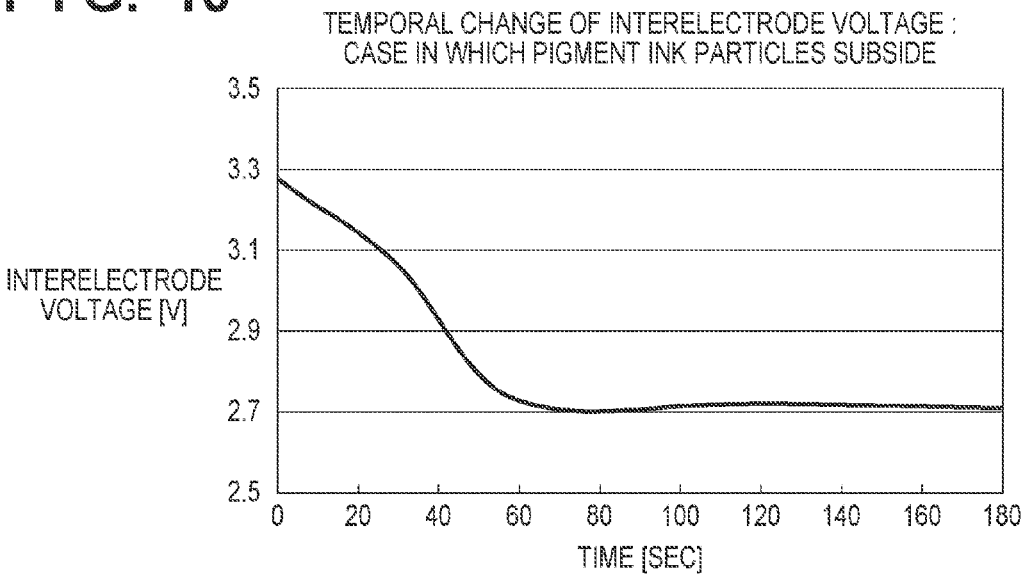
FIG. 10 is a graph showing a temporal change of the voltage value that is detected by the detector when an AC voltage is applied to pigment ink whose pigment particles subside after the pigment ink is left to stand for about 30 days.

FIG. 10 is a graph showing a temporal change of the voltage value that is detected by the detector 901 when an AC voltage is applied to pigment ink whose pigment particles subside after the pigment ink is left to stand for about 30 days. FIG. 10 shows a behavior in which the interelectrode voltage keeps decreasing for about 60 sec after application of the AC voltage and then maintains a constant value.

Figure 11:
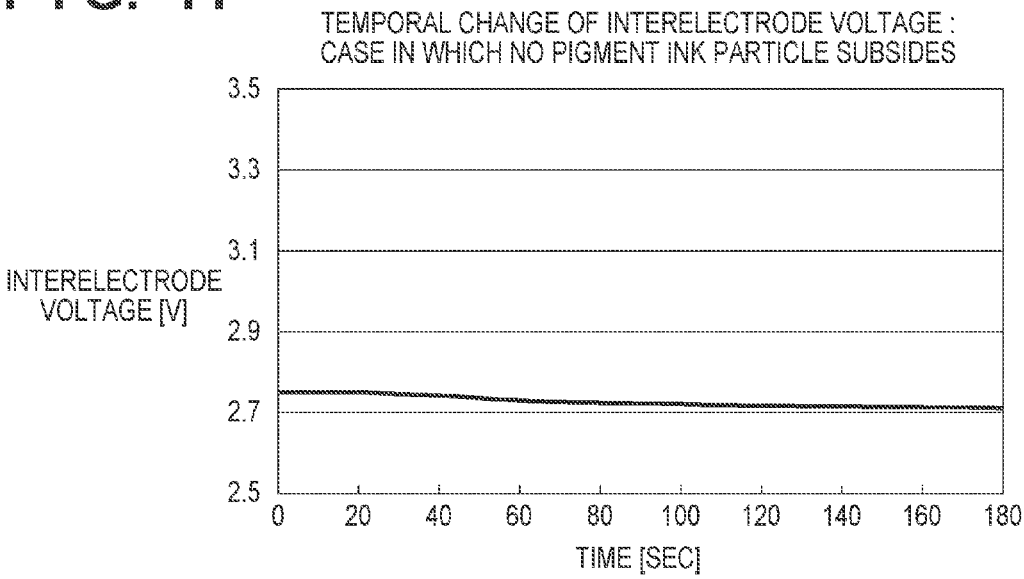
FIG. 11 is a graph showing a temporal change of the voltage value that is detected by the detector when an AC voltage is applied to pigment ink whose pigment particles hardly subside after the pigment ink is left to stand for about 12 hours.

FIG. 11 is a graph showing a temporal change of the voltage value that is detected by the detector 901 when an AC voltage is applied to pigment ink whose pigment particles hardly subside after the pigment ink is left to stand for about 12 hours. In FIG. 11, the interelectrode voltage hardly changes and maintains a constant value.

As is apparent from the temporal change characteristics of the interelectrode voltage shown in FIGS. 10 and 11, the dispersion state of pigment particles can be grasped using the interelectrode voltage characteristic when an AC voltage is applied to pigment ink. By using this characteristic, the stirring operation can be controlled appropriately. For example, a threshold $V_{TH}$ is set to 2.75 V for the interelectrode voltage. The interelectrode voltage becomes lower than 2.75 V about 60 sec after application of the AC voltage in the temporal change shown in FIG. 10, and immediately after the start of applying the AC voltage in the temporal change shown in FIG. 11. An interelectrode voltage $V_{ee}$ is compared with the threshold, and when $V_{ee}<V_{TH}$, it is determined that the pigment ink has been stirred satisfactorily. Then, the controller 902 stops the application of the AC voltage from the AC power supply.

As described above, according to the embodiment, the interelectrode voltage after application of the AC voltage is monitored, and when it reaches a predetermined value, the power supply is stopped. By this simple control, the pigment particles of pigment ink can be dispersed sufficiently. The embodiment is advantageous because neither the contents of previous printing and stirring operations nor the elapsed time after previous printing and stirring operations need be stored.

Note that the control of the AC power supply is not limited to only the above-described embodiment, and the following control arrangement is also available.

Figure 12:
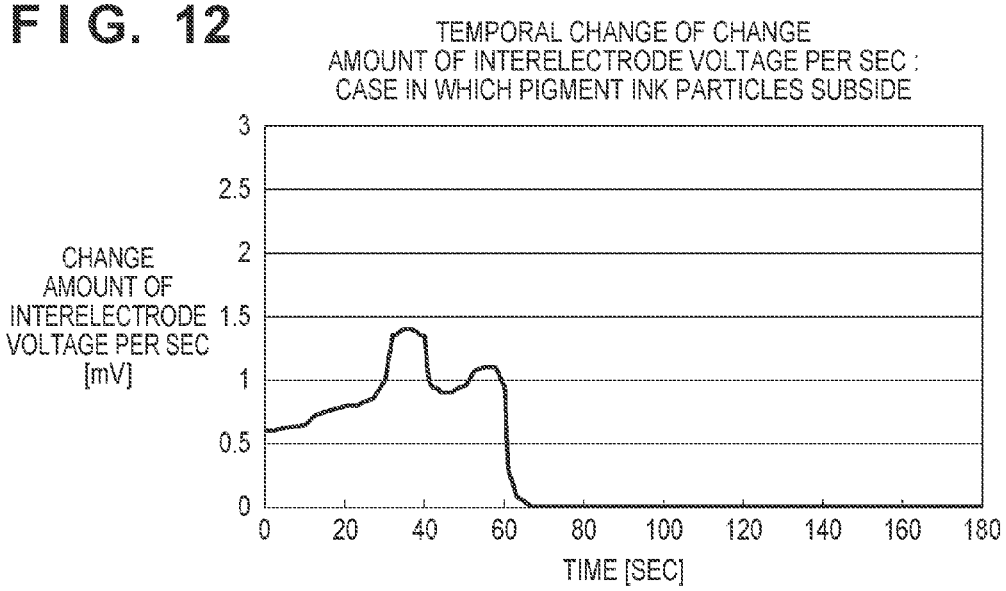
FIG. 12 is a view showing a temporal change of an interelectrode voltage change amount per sec that is calculated based on a temporal change of the voltage in the same case as that shown in FIG. 10 in which the pigment particles of pigment ink subside.

FIG. 12 is a view showing a temporal change of the interelectrode voltage change amount per sec that is calculated based on a temporal change of the interelectrode voltage in the same case as that shown in FIG. 10 in which the pigment particles of pigment ink subside. Similarly, FIG. 13 is a view showing a temporal change of the interelectrode voltage change amount per sec that is calculated based on a temporal change of the interelectrode voltage in the same case as that shown in FIG. 11 in which no pigment ink particle subsides.

Figure 13:
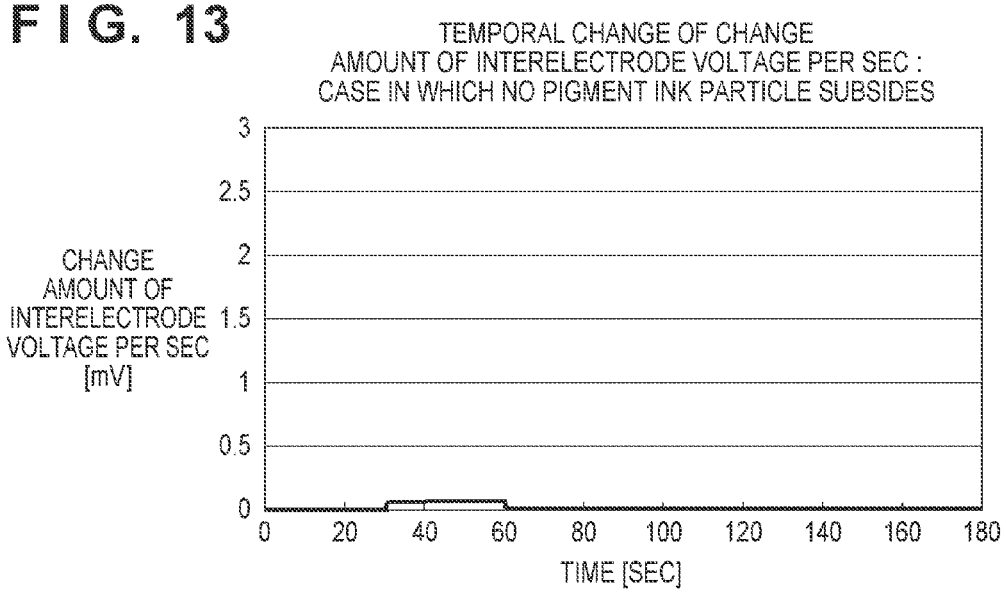
FIG. 13 is a view showing a temporal change of an interelectrode change amount per sec that is calculated based on a temporal change of the voltage in the same case as that shown in FIG. 11 in which no pigment ink particle subsides.

From the temporal change characteristics shown in FIGS. 12 and 13, the stirring operation can be properly controlled using the change amount of the interelectrode voltage per predetermined time. For example, the threshold is set to 0.4 mV for the change amount (change rate) of the interelectrode voltage per sec. The change rate becomes lower than 0.4 mV about 60 sec after application of the AC voltage in the example shown in FIG. 12, and immediately after the start of applying the AC voltage in the example shown in FIG. 13. The change rate of the interelectrode voltage is monitored, and when it becomes lower than the threshold, it is determined that the pigment ink has been stirred satisfactorily. The controller controls to stop application of the AC voltage from the AC power supply.

Similar to the above-described embodiment, even this control arrangement can easily control the stirring operation in accordance with the dispersion state of the pigment particles of pigment ink. Also in this case, neither the contents of previous printing and stirring operations nor the elapsed time after previous printing and stirring operations need be stored.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-226057, filed Oct. 5, 2010, which is hereby incorporated by reference herein in its entirety.

What is claimed is:

1. A printing apparatus which prints on a printing medium by supplying ink from a first container, that is formed from an electrically insulating member and contains pigment ink containing a solvent and pigment particle different in permittivity, to a printhead, comprising:

a thin plate-like first electrode which is arranged to contact an outer surface of the first container;

a thin plate-like second electrode which is smaller in surface area than said first electrode, and is arranged to face said first electrode and contact an outer surface of the first container such that said first and second electrodes sandwich the first container;

a power supply unit configured to apply an AC voltage to said first electrode and said second electrode;

a detection unit configured to detect an interelectrode voltage between said first electrode and said second electrode under a condition where the AC voltage is applied by said power supply unit to said first electrode and said second electrode; and a control unit configured to control to stop application of the AC voltage from said power supply unit based on the interelectrode voltage detected by said detection unit.

2. The apparatus according to claim 1, wherein a small-capacity second container which contains ink supplied from the first container is mounted on the carriage together with the printhead.

3. The apparatus according to claim 2, further comprising a supply unit configured to supply ink from the first container to the second container.

4. The apparatus according to claim 3, wherein said supply unit includes:

a tube which connects the first container and the second container; and one of a mechanism and pump which pressurizes the first container from outside.

5. The apparatus according to claim 1, wherein said second electrode has an elongated trapezoidal shape, contacts the first container to position a narrow portion up and a wide portion down in a vertical direction, so that when the AC voltage is applied, an electric field generated in an upper portion is stronger than that in a lower portion with respect to the first container.

6. The apparatus according to claim 1, further comprising a first determination unit configured to compare the interelectrode voltage detected by said detection unit with a first predetermined threshold and determine that the pigment ink is satisfactorily stirred based on a result of the comparison.

7. The apparatus according to claim 1, wherein the control unit is further configured to stop application of the AC voltage from said power supply unit based on a change rate of the interelectrode voltage detected by said detection unit per predetermined time.

8. The apparatus according to claim 7, further comprising a second determination unit configured to compare the change rate with a second predetermined threshold and determine that the pigment ink is satisfactorily stirred based on a result of the comparison.

9. The apparatus according to claim 1, wherein the printhead is separated from the first container and mounted on a carriage that reciprocally moves.

* * * * *